United States Patent [19]

Davis

[11] 4,206,448

[45] Jun. 3, 1980

[54] MULTIPLE MODE SOUND GENERATOR

[76] Inventor: Curtis H. Davis, 3333 Sand Point Rd., Fort Wayne, Ind. 46809

[21] Appl. No.: 861,728

[22] Filed: Dec. 19, 1977

[51] Int. Cl.[2] ..... G08B 3/00

[52] U.S. Cl. ..... 340/384 E; 340/384 R

[58] Field of Search ..... 340/384 E, 384 R; 331/108 C, 108 D; 29/577, 594

[56] References Cited

U.S. PATENT DOCUMENTS

| | | | |
|---|---|---|---|
| 3,747,092 | 7/1973 | Smith | 340/384 E |
| 3,875,526 | 4/1975 | Beeman | 331/108 D |
| 3,882,275 | 5/1975 | Carroll | 340/384 E |
| 3,902,140 | 8/1975 | Grebene | 331/108 C |
| 3,927,399 | 12/1975 | Fuzzell | 331/108 D |
| 3,995,268 | 11/1976 | Ferrari | 340/384 E |

*Primary Examiner*—Harold I. Pitts
*Attorney, Agent, or Firm*—Richard T. Seeger

[57] ABSTRACT

A standard dual timing integrated circuit contains two independent 555-type timers on a single monolithic chip, each timer section has a terminal pin for connection to external circuitry for supply voltage, control voltage, and has internal circuitry which has terminal pins for connection to external circuitry for reset, trigger, output, discharge, and threshold connections. A multiple resistance-capacitor circuit is connected to the discharge, threshold, trigger, and ground pins of the first timer section with the resistance values being manually selectable between three discrete resistance values, each corresponding to a predetermined sound mode, to provide three separate discharge rates of the capacitor and thus provide at the output pin of the first timer section a voltage waveform of one of three predetermined configurations corresponding to the selected sound mode. Thus, the first timer section acts as a modulator. Wave shaping circuitry comprising a resistance-capacitor circuit having multiple discrete selectable capacitance values which are manually selected with the selection of a sound mode waveform, is coupled between the output terminal of the first modulator timer section and the control terminal of the second timer section. The second timer section is connected as a free running multivibrator and has a speaker connected at its output. Thus, the second timer section is employed as a voltage controlled oscillator with the shaped waveform applied to its control input causing a corresponding frequency at its output and a corresponding audible tone from the speaker.

13 Claims, 4 Drawing Figures

MULTIPLE MODE SOUND GENERATOR

BACKGROUND OF THE INVENTION

1. Field of the Invention

This invention is in the field of multiple tone generators and more particularly to a siren having multiple sound modes.

2. Description of the Prior Art

Siren circuits are known to the art. Circuits having multiple sound modes have become prevalent, especially in recent years, in law enforcement and emergency vehicles. It has been found that by changing the sound from one mode to another, that motorist's attention can more reliably be gained. Therefore, circuits having a "high-low", "wail", and "yelp" sound modes have been employed. The circuitry employed in such systems to obtain the three sound modes has been relatively complex and expensive to manufacture, having many individual components, which resulted in attendant increased maintenance due to component failure or wiring and connection failure between components. In addition, the container required to house such components was necessarily relatively bulky in size and heavy in weight, further limiting the applications and making the device less convenient to use.

SUMMARY OF THE INVENTION

A standard, commercially available, dual timer integrated circuit has a first timer section coupled to a resistance capacitance circuit having three discrete resistance values, selectable by a manually operated sound mode switch, each resistance corresponds to a separate and distinct siren sound mode. In the disclosed embodiment, the sound modes are "high-low", "wail", and "yelp". The circuit is coupled to the discharge, threshold, trigger, and ground terminals of the first timer section and according to the manually selectable resistance values, provides at the output pin of the first section a square waveform for the "high-low" mode; a modified saw tooth waveform for the "wail" mode; and a further modified saw tooth waveform higher frequency for the "yelp" mode. The waveform at the output terminal is shaped by a resistance capacitance circuit which prevents cutoff or truncation of the peaks of the wail and yelp waveforms and has a capacitance for each of these waveforms which is manually selectable, as by a ganged switch, with the sound mode resistance selection of the first resistance-capacitance circuit for the wail and yelp modes.

The output of the wave-shaping resistance capacitance circuit is applied to the control terminal of the second timer section of the dual timer circuit. The discharge, threshold, and trigger terminals of the second timer section are connected to wave-shaping circuitry so that the second timer section acts as a free running multivibrator with the vibration frequency at the output of the second timer section being directly related to the voltage amplitude at the control pin. A speaker is coupled to the output pin of the second timer section and will emit an audible tone corresponding to the frequency at the output pin. A "free-wheeling" or "kick suppressing" diode is connected across the speaker to protect the circuit from inductive reactance of the speaker coil.

A battery is provided to the voltage supply pin of the timer circuit and due to the comparative circuitry used in the timer sections, the battery supply voltage can vary plus or minus fifty percent (50%) and still provide an operable circuit, which is especially desirable in battery operated circuits. Similarly, due to the comparative circuitry used, the siren is stable over a wide temperature range since any deviation of electrical characteristics of the circuit is compensated by a similar deviation in the comparative circuit elements, which is especially desirable in vehicle carried circuits. Thus, the frequency output of the second timer section, and the corresponding audible tone from the speaker, will have only a slight variation, plus or minus a few percent, even though the voltage supply swing is plus or minus fifty percent (50%) and the ambient temperature range is relatively wide. Thus, a multiple sound mode siren circuit is provided of exceptionally low cost in manufacture and maintenance, can be packaged in a relatively small container, is relatively light in weight, and can operate over a large swing in supply voltage and temperature range. The circuit is exceptionally suitable for low cost applications, such as toys or the like, or can be used in emergency applications with the same advantages.

It is therefore an object of this invention to provide a multiple sound mode siren of exceptionally low cost in manufacture and maintenance and can be packaged in a relatively small container housing and is light in weight.

A further object of this invention is to provide in such a siren circuitry which can operate satisfactorily with relatively wide swings in supply voltage and ambient temperature.

A further object of this invention is to utilize standard integrated circuit components in the manufacture of the device of the previous objects.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 1:
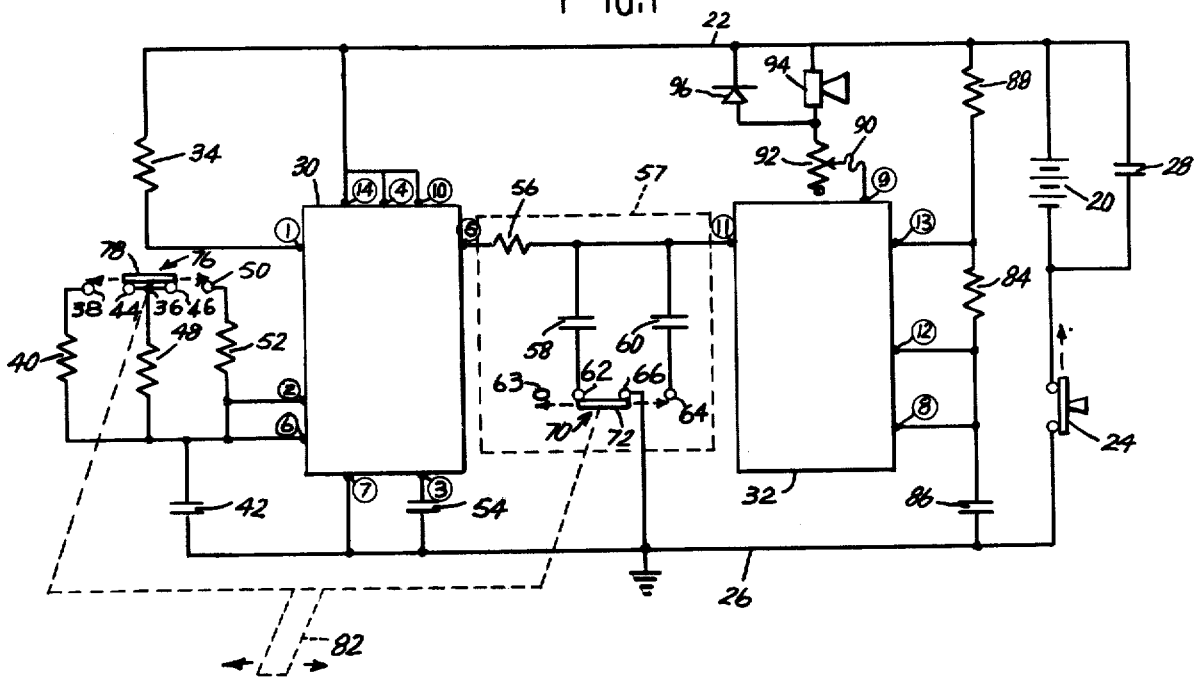
FIG. 1 is a schematic diagram of a preferred embodiment of a generator of this invention.

Referring to FIG. 1 of the drawing, a battery 20 has its positive terminal connected to supply line 22 and its negative terminal connected through slide switch 24, shown in the "on" position to ground line 26. A capacitor 28 is coupled across battery 20 to filter circuit disturbances and maintain a substantially constant battery voltage. A dual 555-timer circuit such as an RCA NE566A, having a first timer section 30 and a second timer section 32 has pins 1 to 14 which are so numbered in the drawing and enclosed in circles and represent the following:

| | |
|---|---|
| (1) - Discharge | (8) - Trigger |
| (2) - Threshold | (9) - Output |
| (3) - Control | (10) - Reset |
| (4) - Reset | (11) - Control |
| (5) - Output | (12) - Threshold |
| (6) - Trigger | (13) -Discharge |

-continued

| | |
|---|---|
| (7) - Ground | (14) - V+ |

The above circuits are discussed in more detail in the following publications:

Signetics Data Book © 1976 Signetics Corp., analog Section page 162ff.

XR-2556 Dual Timing Circuit—Product Data Sheet EXAR Integrated Systems, Inc., 750 Palomar Avenue, Sunnyvale, Calif. 94086, Copyright 1973.

For convenience, pins 10 and 14, although being connected from section 32, are shown connected from section 30 since, along with pin 4, have a common connection to supply line 22. Pin 1 is coupled through resistance 34 to line 22 and to junction 36. A terminal 38 is coupled through a resistance 40 to one plate of capacitor 42, the other plate of which is connected to ground line 26; terminals 44 and 46 are coupled through resistance 48 to the one plate of capacitor 42; and terminal 50 is coupled through resistance 52 to one plate of capacitor 42; pins 2 and 6 are coupled to the one plate of capacitor 42.

Pin 7 is coupled to ground line 26 and pin 3 is coupled through bypass capacitor 54 to ground line 26. Capacitor 54 bypasses extraneous noise pulses to ground. Pin 5 is coupled to one terminal of resistance 56, of integrator circuit 57 shown in dashed lines, the other terminal of resistance 56 being coupled to pin 11 and through capacitors 58, 60 to terminals 62, 64 respectively, terminal 63 being unconnected. Terminal 66 is coupled to ground line 26. A slide switch 70 having conductive bar 72 is ganged to a slide switch 76 having conductive bar 78. Switches 70 and 76 are manually slidable in unison by manual operation of tab 82. As will become apparent, when switches 70 and 76 are in their leftmost position wherein bar 78 is bridging terminals 38 and 44, and bar 72 is bridging terminals 62 and 63, the sound generator will produce a "high-low" sound; in the center position, as shown in the drawing, wherein bar 78 is bridging terminals 44, 46, a "wail" sound will be produced; and in the rightmost position wherein bar 78 is bridging terminals 46, 50 and bar 72 is bridging terminals 66 and 64, a "yelp" sound will be produced.

Pins 8 and 12 are coupled to one terminal of resistor 84 and one plate of capacitor 86, the other plate of which is coupled to ground line 26. Pin 13 is coupled to the other terminal of resistor 84 and to supply line 22 through resistor 88. The values of resistors 84, 88 and capacitor 86 determine the free running frequency of section 32 which is connected as a voltage controlled oscillator with the frequency at pin 9 being in direct correspondence to the voltage at pin 11. Pin 9 is coupled to slider 90 of potentiometer 92 which is coupled through speaker 94 to supply line 22. A diode 96 has its anode connected to one side of speaker 94 and its cathode connected to supply line 22 and acts to suppress the inductive "kick" of speaker 94, and is commonly referred to as a "free-wheeling diode".

Section 30 of the integrated circuit, together with resistances 34, 40, 46, and 52, and capacitors 42, 54 comprise the "modulator" circuit portion of the generator; resistance 56 and capacitors 58 and 60 comprise the "integrator" circuit portion of the generator; and section 32 of the integrated circuit together with resistances 84, 88 and capacitor 86 comprise the "voltage controlled oscillator" portion of the generator. Battery 20 supplies the Vcc voltage when switch 24 is in the "on" position, as shown, and can vary from 5 to 15 volts, which is 10 volts plus or minus fifty percent (50%), and still achieve satisfactory operation of the generator. The reason that this relatively wide voltage swing is possible is that the circuits in sections 30 and 32 are connected in a "comparative" manner and voltage ratios are used to achieve circuit function. Therefore, there will be a ratio compensation for any gradual change in supply voltage so that a change of as much as a plus or minus fifty percent (50%) in the supply voltage will result in only a change of a few percent in the output frequency at pin 9 for any given sound mode. Further, for the same reasons, the generator will tolerate a substantially wide range of ambient temperatures with ratio compensation occurring for temperature extremes.

In operation of the generator, assuming switches 70 and 76 to be in their leftmost position to generate a "high-low" sound, and assuming switch 24 to be in the "on" position, as shown, capacitor 42 will be charged through resistor 34 and the parallel combination of resistors 40, 48 due to bar 78 being positioned over terminals 38, 44. After a predetermined time, the voltage on the upper plate of capacitor 42, and pins 2 and 6 will be of a sufficient value to trigger or close an internal circuit between pin 1 and pin 7 causing a "dumping" of charge from the upper plate of capacitor 42 to ground line 26 through pin 7. After the charge on the upper plate of capacitor 42 has fallen to a predetermined level, as sensed at pin 6, the connection between pins 1 and 7 will be opened and the charge will again begin to build on capacitor 42 repeating the cycle. A substantially square voltage waveform will occur at pin 5 and will be similar to that shown in FIG. 2*a* with the time between t0 and t1 representing the time required to build a charge on capacitor 42 that is sensed at pin 2, after which time the connection is made between pins 1 and 7 dumping the charge from capacitor 42 to ground line 26 causing a corresponding abrupt change of voltage at pin 5. Thus, the charge on capacitor 42 builds until time t1 when the threshold voltage at pin 2 is reached at which time the voltage at pin 5 abruptly falls to level V2 where it is held until the charge of capacitor 42 discharges through resistances 40, 46, and pins 1 and 7 to ground line 26 until the voltage at pin 6 reaches a predetermined minimum, at time t2, at which time the voltage at pin 5 will rise to level V1. This continues to give a substantially square wave with a time constant determined by resistances 40, 46 and capacitor 42. Resistance 34 also aids in determining the charging time constant and is placed in the circuit to protect section 30 from excessive current at pin 1.

Figure 2A:
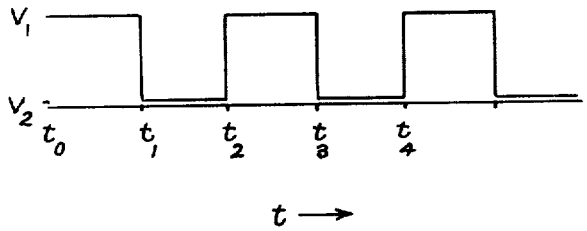
FIGS. 2*a*–2*c* are waveform taken at the input to the second 555-timer integrated circuit for the "high-low", "wail", and "yelp" modes of sound generation.

The "high-low" position of switch 70 has bar 72 bridging terminals 62 and 63 which effectively eliminates capacitors 58, 60, from the circuit causing a substantially square wave, as shown in FIG. 2*a*, to be applied to pin 11 of section 32. This causes a substantially two frequency output at pin 9; a first high frequency is associated with level V2 at pin 11 and a second lower frequency is associated with level V1 at pin 11, the levels changing at t1, t2, t3, etc. The frequencies at pin 9 drive speaker 94 to produce an audible sound corresponding thereto. It is understood that buffer amplifiers may be placed in the circuit between pin 9 and speaker 94 to achieve a desired volume from speaker 94.

Figure 2B:
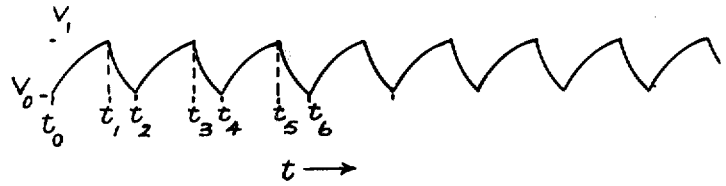

In the "wail" mode, switches 70 and 76 are positioned as shown in the diagram with bar 78 bridging terminals 44, 46. In switch 70, bar 72 bridges terminals 62 and 66 thus placing capacitor 58 in integrating circuit 57 for purposes later explained. The operation in the "wail" mode is similar to that described for the "high-low" mode with the exception that the charging time constant is determined by resistance 34 in series with resistor 48 in combination with capacitor 42. The waveform at pin 5 has a frequency corresponding to such "wail" mode charging time constant but would not have the desired waveform peaks. To achieve a peaked waveform, capacitor 58 is placed in the circuit so that a waveform similar to that shown in FIG. 2*b* is applied to pin 11 of section 32. The output at pin 9 has a gradually decreasing frequency until voltage level V1 is reached, at time t1, at which time the frequency is gradually increased until time t2 is reached at which time the frequency is again decreased corresponding to the increasing voltage applied to pin 11, with the cycle repeating to produce a "wail" sound.

Figure 2C:
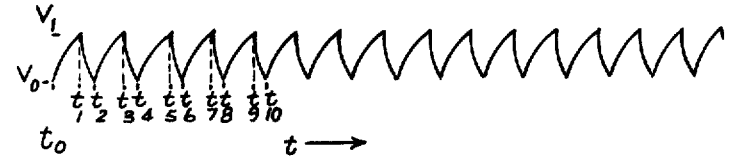

In the "yelp" position of switches 70 and 76, bar 78 bridges terminals 46 and 50 while bar 72 of switch 70 bridges terminals 64, 66 thus placing capacitor 60 in the integrating circuit. In the "yelp" position, the time constant of the waveform applied to pins 2 and 6 is determined by resistances 34, and the parallel combination of resistances 48, 52, and capacitor 42. This results in a waveform at pin 5 having a higher repetitive rate than that for the "wail" setting. Again, to achieve a peaked waveform, capacitor 60 is placed in the circuit to provide a waveform similar to that shown in FIG. 2*c* at pin 11. The frequencies at pin 9 rise and fall corresponding to the voltages applied to pin 11, which frequencies are transduced into an audible sound by virtue of pin 9 being drivingly connected to speaker 94.

Thus, a relatively simple circuit, comprising a single integrated circuit chip coupled with a minimum number of resistances and capacitances, and relatively inexpensive slide switches, is used to drive a speaker and produce a three mode sound generator which previously has required relatively complex circuitry. The circuit requires only a relatively small housing and is ideally suitable for application in toy vehicles but also may be provided with suitable buffer amplifiers to drive higher volume speakers for use in law enforcement or emergency vehicles.

It is to be understood that two separate 555-timers, one for circuit 30 and one for circuit 32, connected as indicated for the dual timer, could be used in this invention. Also, the sections 30, 32 of the dual timer could have their respective pin connections interchanged so that section 32 acts as the modulator and section 30 acts as the voltage controlled oscillator and still provide the described functions.

A satisfactory working embodiment designed for toy vehicles has the following component values:

| Resistances | |
|---|---|
| Reference Numeral | Value (Ohms) |
| 34 | 10K |
| 40 | 330K |
| 48 | 820K |
| 52 | 68K |
| 56 | 6.8K |
| 84 | 100K |
| 88 | 10K |
| 92 | 1K potentiometer |
| Capacitances | |
| Reference Numeral | Value (Microfarads) |
| 42 | 3.3 |
| 54 | .01 |
| 58 | 250 |
| 60 | 6.8 |
| 86 | .01 |
| 28 | 100 |
| Diode | |
| 96 | IN4454 |
| Speaker | |
| 94 | 100 ohm coil type speaker |
| Battery | |
| 20 | 9 volt D.C. |

While there have been described above the principles of this invention in connection with specific apparatus, it is to be clearly understood that this description is made only by way of example and not as a limitation to the scope of the invention.

What is claimed is:

1. The method of producing a multiple mode sound generator by use of an NE566 integrated circuit having pins 1 to 14 comprising the steps of:

coupling a voltage source to pins 4, 10, and 14;

coupling said voltage source through a first resistance to pin 1 and through a second resistance to pin 13;

coupling manually selectable resistances in parallel between pin 1 and a common line to pins 2 and 6;

coupling a first capacitance between a ground line and a common line to pins 2 and 6;

coupling a first resistance between pin 13 and a common line connecting pins 8 and 12;

coupling a second capacitance between the ground line and said common line to pins 8 and 12;

coupling a speaker means between the voltage source and pin 9 whereby the speaker means will be driven with frequencies corresponding to the values of the manually selectable resistances, first and second resistances, and first and second capacitances.

2. The method of claim 1 including the steps of:

coupling manually selectable capacitances between pin 11 and the ground line;

coupling a third resistance between pins 5 and 11.

3. The method of claim 1 including the steps of:

coupling a potentiometer between the speaker means and pin 9.

4. A multiple sound producing generator comprising:

circuitry having ground, supply, first and second trigger, first and second output, first and second control, first and second threshold, and first and second discharge terminals;

said circuitry having first means for coupling said first discharge terminal to said ground terminal when a predetermined voltage is applied to said first threshold terminal to produce a first voltage at said first output terminal;

second means for decoupling said first discharge and ground terminals when a predetermined minimum voltage is at said first trigger terminal and for producing at said first output terminal a second voltage;

first resistor-capacitor means coupled to said voltage supply, first discharge, first threshold, first trigger, and ground terminals for applying a selectable predetermined waveform to said first trigger and threshold terminals;

second resistor-capacitor means coupled between said first output terminal and said second control terminal for selectably shaping the waveform from said first output terminal;

third means for coupling said second discharge terminal to ground when a predetermined voltage is at said second threshold terminal to produce a third voltage at said second output terminal;

fourth means for decoupling said second discharge and ground terminals when a predetermined minimum voltage is at said second trigger terminal and for producing at said second output terminal a fourth voltage;

third resistor-capacitor means coupled to said voltage supply, second discharge, second threshold, and second trigger terminals for providing a predetermined free running frequency at said second output terminal;

fifth means for varying said free running frequency in correspondence to the voltage at said second control terminal; and sixth means coupled to said second output terminal for producing an audible signal corresponding in frequency to the frequency at said second output terminal.

5. The device of claim 4 wherein said first resistor-capacitor means comprises a capacitor coupled between said first trigger terminal and said ground terminal; a plurality of resistances connected in parallel being between said supply and a common connection to said first trigger and threshold terminals; switch means for selecting certain of said resistances for connection between said supply and said common connection.

6. The device of claim 4 wherein said second resistor-capacitor means comprises a resistance coupled between said first output terminal and said second control terminal;

a plurality of capacitances being coupled between said second control terminal and ground;

switch means being coupled between said plurality of capacitances and ground for selecting certain of said capacitances for connection to ground.

7. The device of claim 6 including means for ganging said first and second switch means to select predetermined combinations of certain of said plurality of resistances and certain of said plurality of capacitances upon a predetermined ganged movement of said first and second means.

8. The device of claim 4 wherein said third resistor-capacitor means comprises a resistance coupled between said supply voltage and a common connection to said second threshold and trigger terminal; and a capacitor being coupled between said second trigger terminal and ground.

9. The device of claim 4 wherein said sixth means comprises a speaker and potentiometer coupled between said second output terminal and said voltage supply.

10. A multiple sound producing circuit having an NE566A circuit means having pins 1 to 14 that improvement comprising:

a voltage source connected to pins 4, 10, and 14;

a first and second resistance;

said voltage source coupled through said first resistance to pin 1 and through said second resistance to pin 13;

a ground line;

selectable resistance means coupled between pin 1 and a common line to pins 2 and 6;

a first capacitance means coupled between said common line and said ground line;

a third resistance connected between pin 13 and a common line to pins 8 and 12;

a second capacitance means coupled between said ground line and said common line to pins 8 and 12;

speaker means being connected between said voltage source and pin 9;

whereby said speaker means will be driven with a frequency pattern corresponding to the resistance value of the selectable resistance means.

11. The circuit of claim 10 wherein selectable capacitance means is coupled between pin 11 and said ground line;

a fifth resistance coupled between pin 5 and a common line to pin 11 and said selectable capacitance means;

means for selecting certain of the resistances in the selectable resistance means and certain of the capacitances in the selectable capacitance means to provide selection combinations of said certain resistances and said certain of said capacitances.

12. A multiple mode sound generator comprising:

first means for producing a plurality of manually selectable resistance-capacitance time constants;

second means coupled to said first means for providing a substantially square waveform having a period corresponding to the selected time constant;

third means coupled to said second means for selectably shaping in a predetermined manner at least one of said waveforms;

fourth means coupled to said third means for providing frequencies corresponding to the instantaneous magnitudes of said waveforms;

fifth means coupled to said fourth means for transducing said frequencies to a corresponding audible sound;

said first means producing three time constants corresponding to "high-low", "wail", and "yelp" sound modes; and said third means shapingly peaks only the "wail" and "yelp" waveforms.

13. The device of claim 12 including sixth means associated with said first and third means for coordinating selection of said time constants with a predetermined manner of wave shaping.

* * * * *